US012186801B2

(12) United States Patent
Tipton et al.

(10) Patent No.: US 12,186,801 B2
(45) Date of Patent: Jan. 7, 2025

(54) MOLD PUMP

(71) Applicant: PYROTEK, INC., Spokane, WA (US)

(72) Inventors: Jon Tipton, Aurora, OH (US); Andrew Horsfall, Solon, OH (US); Jay Fritzke, North East, PA (US); Richard S. Henderson, Solon, OH (US)

(73) Assignee: Pyrotek, Inc., Spokane, WA (US)

( * ) Notice: Subject to any disclaimer, the term of this patent is extended or adjusted under 35 U.S.C. 154(b) by 0 days.

(21) Appl. No.: 15/513,694

(22) PCT Filed: Sep. 25, 2015

(86) PCT No.: PCT/US2015/052244

§ 371 (c)(1),
(2) Date: Mar. 23, 2017

(87) PCT Pub. No.: WO2016/049468

PCT Pub. Date: Mar. 31, 2016

(65) Prior Publication Data

US 2017/0246681 A1 Aug. 31, 2017

Related U.S. Application Data

(60) Provisional application No. 62/193,166, filed on Jul. 16, 2015, provisional application No. 62/076,057,
(Continued)

(51) Int. Cl.
*B22D 39/04* (2006.01)
*B22D 13/02* (2006.01)
(Continued)

(52) U.S. Cl.
CPC ..... *B22D 39/04* (2013.01); *B22D 13/02* (2013.01); *B22D 13/107* (2013.01); *B22D 13/12* (2013.01);
(Continued)

(58) Field of Classification Search
CPC ..... B22D 17/30; B22D 17/32; B22D 39/04; F04D 7/065; F04D 15/0066
See application file for complete search history.

(56) References Cited

U.S. PATENT DOCUMENTS 2,846,740 A 8/1958 Edstrand
3,235,922 A * 2/1966 Kaji ..... B22D 39/00 164/157
(Continued)

FOREIGN PATENT DOCUMENTS

EP 1900456 A1 * 3/2008 ..... B22D 1/007
KR 2009118561 A 11/2009
(Continued)

OTHER PUBLICATIONS

International Search Report (PCT/ISA/210) for PCT/US2015/052244.

*Primary Examiner* — Kevin E Yoon
*Assistant Examiner* — Jacky Yuen
(74) *Attorney, Agent, or Firm* — Lippes Mathias LLP

(57) ABSTRACT

A molding machine for molding material is provided. The machine includes a cavity to be filled with molten metal and a conduit system leading to the cavity, thus forming a system of interconnected hollow spaces. At least one pressure member is moveable in at least part of the conduit system. A centrifugal pump in fluid communication with a reservoir of molten metal is provided, the pump providing molten metal to the hollow space receiving the at least one pressure member.

11 Claims, 9 Drawing Sheets

Related U.S. Application Data filed on Nov. 6, 2014, provisional application No. 62/055,921, filed on Sep. 26, 2014.

(51) Int. Cl.

| | |
|---|---|
| ***B22D 13/10*** | (2006.01) |
| ***B22D 13/12*** | (2006.01) |
| ***B22D 17/08*** | (2006.01) |
| ***B22D 17/20*** | (2006.01) |
| ***B22D 17/30*** | (2006.01) |
| ***B22D 17/32*** | (2006.01) |
| ***B22D 35/04*** | (2006.01) |
| ***F04D 7/06*** | (2006.01) |
| ***F04D 15/00*** | (2006.01) |

(52) U.S. Cl.

CPC ..... *B22D 17/08* (2013.01); *B22D 17/2023* (2013.01); *B22D 17/203* (2013.01); *B22D 17/30* (2013.01); *B22D 17/32* (2013.01); *B22D 35/04* (2013.01); *F04D 7/065* (2013.01); *F04D 15/0066* (2013.01)

(56) References Cited

U.S. PATENT DOCUMENTS

| | | | | | |
|---|---|---|---|---|---|
| 3,252,187 | A * | 5/1966 | Burkett | B22D 17/30 | 222/638 |
| 3,581,767 | A * | 6/1971 | Jackson | B22D 17/30 | 137/563 |
| 4,220,319 | A | 9/1980 | Rohmann | | |
| 4,356,940 | A * | 11/1982 | Ansorge | B22D 39/06 | 222/596 |
| 5,207,267 | A * | 5/1993 | Iwamoto | B22D 17/32 | 164/457 |
| 5,388,633 | A | 2/1995 | Mercer | | |
| 6,152,159 | A * | 11/2000 | Miller | B22D 11/0405 | 137/15.24 |
| 6,426,037 | B1 | 7/2002 | Fieber | | |
| 9,623,478 | B2 * | 4/2017 | Tomita | B22D 17/32 | |
| 2004/0129402 | A1 * | 7/2004 | Boulet | B22D 17/30 | 164/312 |
| 2006/0198725 | A1 | 9/2006 | Thut | | |
| 2008/0190970 | A1 | 8/2008 | Sanders | | |
| 2013/0068412 | A1 * | 3/2013 | Tipton | B22D 17/02 | 164/133 |
| 2013/0101424 | A1 * | 4/2013 | Bright | F04D 1/14 | 416/223 R |

FOREIGN PATENT DOCUMENTS

| | | | |
|---|---|---|---|
| KR | 1020090118561 | A * | 11/2009 |
| WO | 2013144698 | A1 | 10/2013 |

* cited by examiner

MOLD PUMP

BACKGROUND

The present exemplary embodiment relates to a process and apparatus for delivering a measured shot of molten metal. It finds particular application in conjunction with a shot sleeve of a die-casting machine and will be described with particular reference thereto. However, it is to be appreciated that the present exemplary embodiment is also amenable to other similar applications including delivery of a measured shot to a pour cup, ladle, or mold.

In die casting of ferrous and non-ferrous (e.g. aluminum) products, metal is melted in a furnace. The molten metal is stored in a molten state ready for delivery to a mold. A metered amount of molten metal is delivered to the mold. Several devices have been proposed which will deliver a metered amount of molten metal or a shot to the mold. For example, ladeling, magnetic pumps and pressurized furnaces have been employed.

One example of a pressurized furnace is described in U.S. Pat. No. 2,846,740 (the disclosure of which is herein incorporated by reference). The system comprises a crucible communicating with a balance tube and a delivery tube. The balance tube communicates with the molten metal of a furnace and the crucible. The delivery tube communicates with the crucible for delivery of the shot to the mold cavity. The crucible is initially unpressurized. The molten metal inside the crucible is level with a top of the balance tube. The top of the balance tube is slightly above the maximum level of molten metal within the furnace. Air is forced into the crucible and forces the molten metal through the delivery tube into a launder. The amount of metal delivered is controlled by an adjustable timer. Once a predetermined time period has elapsed, a vacuum is applied to the crucible drawing molten metal from both the balance tube and the delivery tube. Molten metal is drawn into the crucible until its level is above the height of the balance tube. The crucible is then vented to the atmosphere allowing the metal to flow back into the furnace until the level of the molten metal in the crucible is the same as the height of the balance tube. Unfortunately, the delivery and balance tubes of these apparatus can degrade over time and/or leak, resulting in poor shot size control.

Developments have been made in order to increase the accuracy of the quantity of shot delivered. One such device is described in U.S. Pat. No. 4,220,319 (the disclosure of which is herein incorporated by reference). In this device, complicated sequences of varying pressures over predetermined time periods are used. The pressure sequences are designed to compensate for smaller amounts of metal being delivered due to the gradual lowering of the level of molten metal in the dosing chamber. However, such devices are complicated, expensive to manufacture and can be difficult to operate.

A further example of a dosing chamber is provided by U.S. Pat. No. 6,426,037, the disclosure of which is herein incorporated by reference. Referring to FIG. 1, a molten metal dosing chamber is shown. The dosing chamber 10 is insertable within the metal holding chamber 5 of a molten metal furnace, generally identified 1. The chamber 10 may be insertable through a shell opening 7 situated in one side of the holding furnace shell 2 or through the top opening 8 of the furnace 1. The shell opening 7 is sealable by means of a refractory plug 3. The dosing chamber 10 is shown in a horizontal orientation and includes a first end portion 11, a top portion 12, a bottom portion 13 and a second end portion 14 form a chamber cavity 17 which is functionally adapted to hold and retain molten metal within its walls. Portion 11 includes a clean out port 26 and plug 27. Gas inlet port 23 is provided in the top chamber portion 12. The inlet port 23 is fitted with a seat 24 including a chamfered inner surface 25 which is functionally adapted to receive the end of a stopper tube 31. It is through this stopper tube 31 that an inert gas, such as nitrogen, is introduced to cavity 17. Near the second end 14 of the top surface 12 a metal outlet port 22 is provided. The metal outlet port 22 includes a sealing shoulder 21 which is functionally adapted to be engageable with the filling end 41 of a stalk tube 42 including discharge spout 43 and metering orifice and flow sensor 44. The stopper tube 31 is vertically movable by virtue of the actuating assembly 36, 37. As recognized by the skilled artisan, a vertical orientation of the dosing chamber is also viable.

As molten metal fills the metal holding chamber 5, molten metal pours into and fills the inner cavity 17 of the dosing chamber 10. The stopper tube 31 is then actuated to lower the bottom most tip into sealing engagement with the seat 24. With the lower end 41 of the stalk tube 42 located over the metal outlet port 22, the dosing chamber 10 is ready to have a predetermined volume of gas introduced through the gas delivery line 34 and into the dosing chamber cavity 17. Since the gas will assume and fill the higher portions of the dosing chamber cavity 17, the molten metal contained within the cavity 17 will be forced out of the dosing chamber 10 via the outlet port 22. The molten metal will then travel up the stalk tube 42 and out to the exterior of the furnace 1 to a pour cup, shot sleeve or other similar device 51. The system of FIG. 1 suffers from drawbacks including variations in efficiency resulting from degradation of the gas introduction components, the fact that a closed system is hard to refill, the fact that compressibility of gas degrades precision, and the requirement that a significant amount of space is consumed.

The present disclosure contemplates the use of a centrifugal pump as a mechanism to deliver a measured quantity of molten metal to a die casting mold. Although centrifugal pumps operate satisfactorily to pump molten metal, they have not been used as a means to fill a die casting mold shot sleeve. Rather, as demonstrated above, this task has been left to magnetic pumps, pressurized furnaces and ladeling. However, these devices suffer from a lack of control associated with the initial compression of the air or the lag in the electromagnetic force. Known centrifugal pumps generally control a flow rate and pressure of molten metal by modulating the rotational rate of the impeller and therefore offer the advantage of responsiveness achieved via direct mechanical interaction with the molten metal. However, RPM control as a mechanism to regulate flow rate and pressure of molten metal transfer has previously not been considered adequate for dispensing a metered quantity of molten metal to a shot sleeve. As recognized by the skilled artisan, the short fill or over fill of a mold can have catastrophic consequences.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In one embodiment, a molding machine for molding material is provided. The machine includes a cavity to be filled with molten metal and a conduit system leading to the cavity, thus forming a system of interconnected hollow spaces. At least one pressure member moveable in at least part of the conduit system is provided with means to control the movement of the pressure member. A centrifugal pump in fluid communication with a reservoir of molten metal is provided, the pump providing molten metal to the hollow space receiving the at least one pressure member.

In another embodiment of the present disclosure, a method for delivering molten metal to a shot sleeve of a casting machine is provided. The method includes the steps of: providing a molten metal furnace having a refractory lining for holding the molten material, introducing a molten metal pump into the furnace, providing the pump with a molten metal outlet conduit in fluid communication with the shot sleeve, and selectively rotating a shaft and impeller assembly of the pump to introduce molten metal to the shot sleeve in a predetermined quantity.

According to a further embodiment, a dosing pump suitable for introducing a molten metal to a casting apparatus is disclosed. The pump comprises a base housing an impeller. The base is arranged to output the molten metal to the casting apparatus. The impeller is connected to a shaft and the shaft connected to a motor. The motor includes an inverter. The inverter is in communication with a PLC including a software program configured to change a current delivered to the inverter such that a predetermined shot weight of the molten metal is delivered to the casting apparatus.

In a further embodiment, a molding machine for molding material is provided. The machine includes a mold having a cavity to be filled with molten metal and a pump in fluid communication with a reservoir of molten metal. An inlet to the cavity includes a shut-off valve comprised of a resilient material and a plunger configured to deform the resilient material.

In another embodiment, a method for delivering molten metal to a mold cavity is provided. The method includes the steps of providing a molten metal furnace holding molten material, associating a molten metal pump with the furnace, providing the pump with a molten metal outlet in fluid communication with the mold cavity and introducing molten metal to the cavity in a predetermined quantity. Thereafter, an inlet to the cavity is sealed by deforming a resilient material.

DETAILED DESCRIPTION

It is to be understood that the detailed figures are for purposes of illustrating the exemplary embodiments only and are not intended to be limiting. Additionally, it will be appreciated that the drawings are not to scale and that portions of certain elements may be exaggerated for the purpose of clarity and ease of illustration.

The use of a centrifugal molten metal pump in the process of die casting is highly challenging. A typical die casting cycle time is 30 to 90 seconds, which requires a shot sleeve to be filled in approximately 3 to 10 seconds. Furthermore, the delivered quantity of molten metal should be within about 2% of the expected quantity. Similarly, it is desirable to provide an initial "slow" speed fill period (e.g. ¼ cycle time), an intermediate "high" speed fill period (e.g. ½ cycle time), and a third pressurized hold period (e.g. ¼ cycle time). The present disclosure is directed to a system that can fulfill these requirements.

Figure 1:
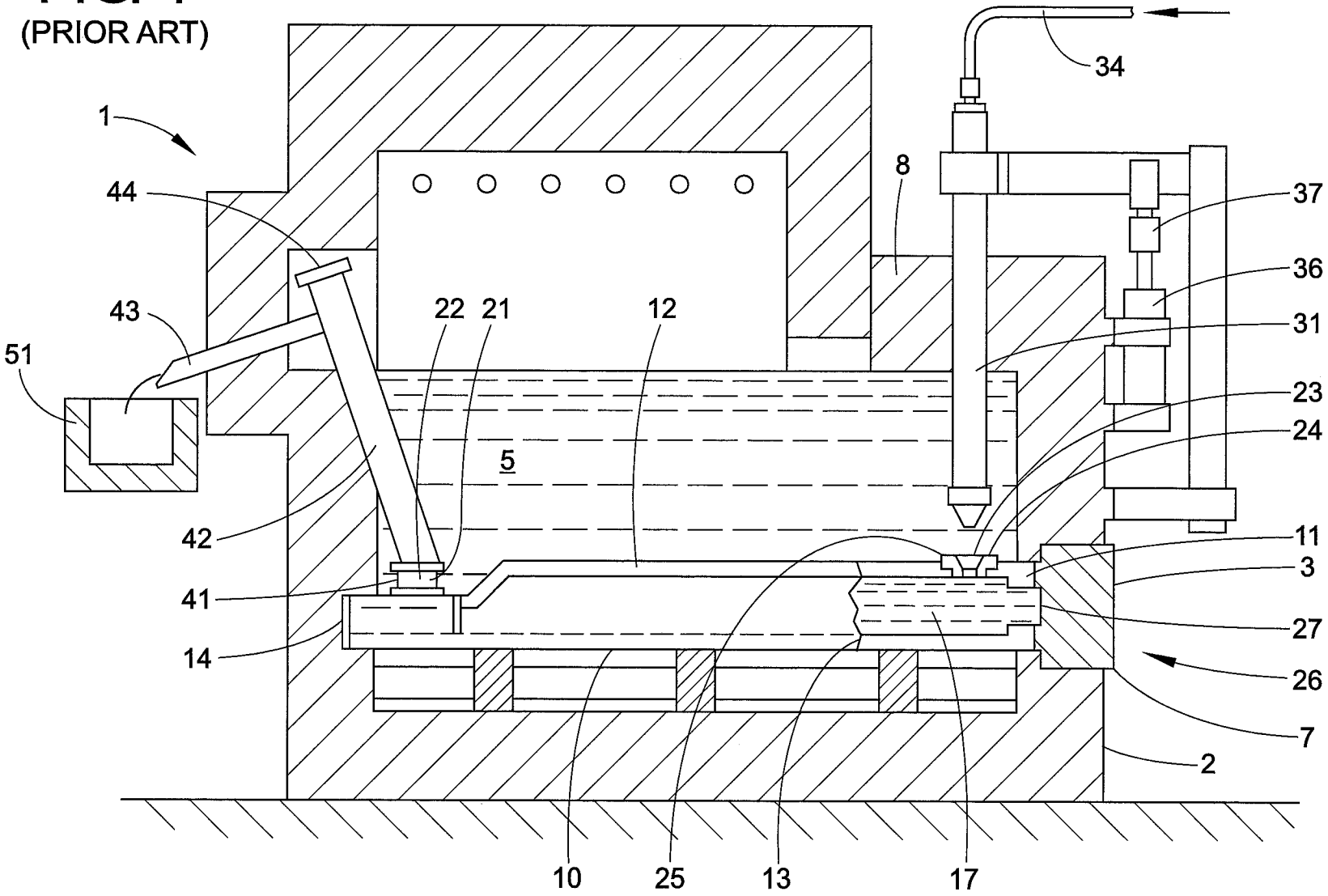
FIG. 1 (PRIOR ART)
FIG. 1 is a front view of a prior art dosing assembly.
Figure 2:
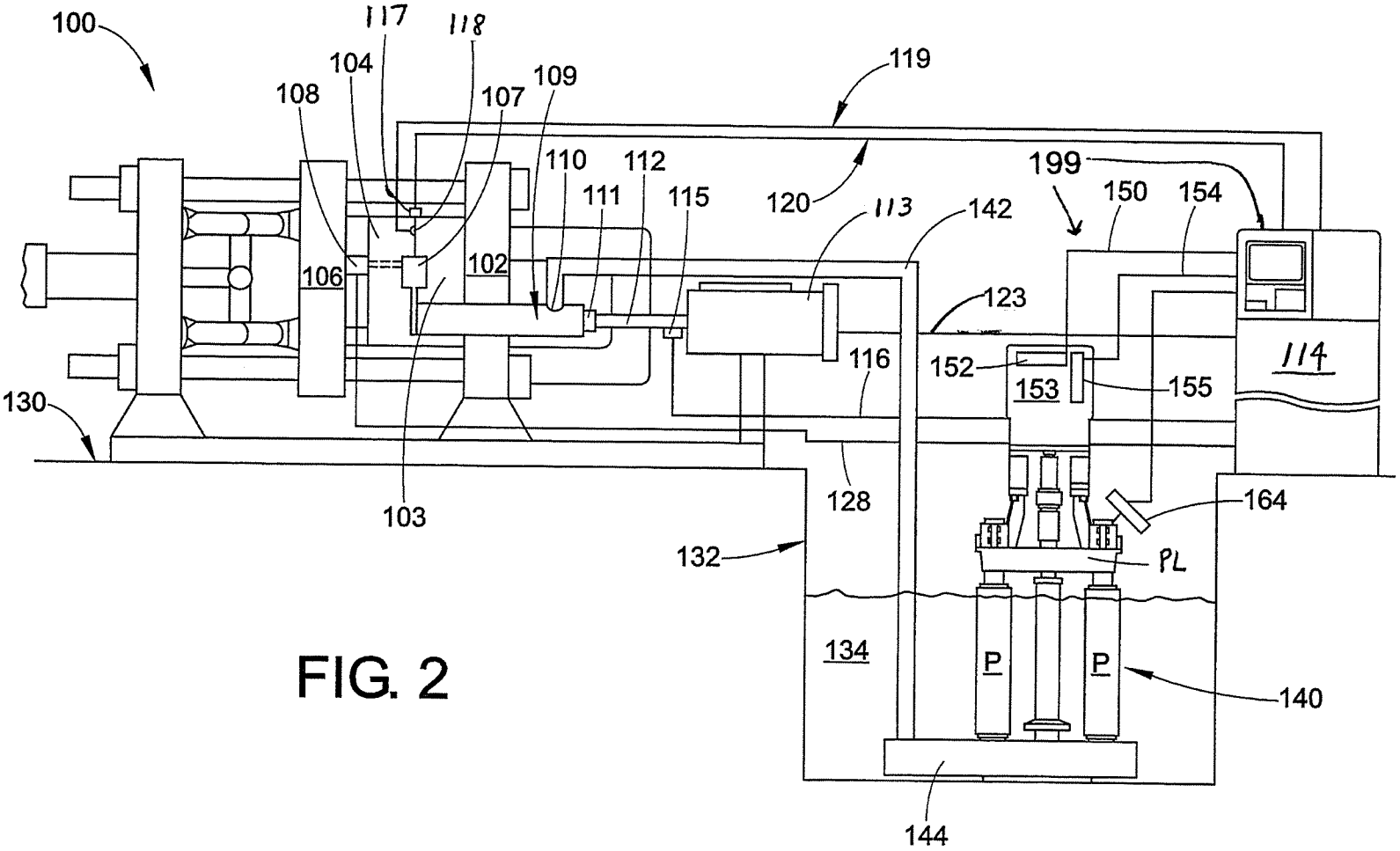
FIG. 2 is a side elevation view of a die-casting apparatus.

With reference to FIG. 2, a die-casting machine 100 comprises a stationary die clamping plate 102 onto which a stationary die half 103 is mounted. This stationary die half 103 together with a moveable die half 104, fastened to a moveable die clamping plate 106, define a die cavity 107. An external after-pressure arrangement 108 can be optionally added to the die cavity 107. After pressure arrangement 108 can be linked to a control unit 114 by a data communication line 128.

A shot sleeve 109 having a filling hole 110 is fastened to the stationary die half 103. A casting piston 111 is displaceable in this shot sleeve 109 by means of a hydraulic drive unit 113 which acts upon its piston rod 112 in order to press metal, that has been filled into the shot sleeve 109 through the filling hole 110, into the die cavity 107. The hydraulic drive unit 113 is controlled by control unit 114 via data communication line 123 which may encompass both electric-electronic components as well as at least part of the hydraulics. To this end, a position sensor and or velocity sensor and/or acceleration sensor 115 as well as other sensors, such as pressure sensors, are coupled to the control unit 114 via data communication line 116, as is known.

A vacuum valve 117 may be provided within the region of the parting plane of both die halves 103, 104. Vacuum valve 117 can be controlled, in the present case, by a quickly reacting metal front sensor 118 interfaced with control unit 114 via data communication line 119. The reaction speed of this sensor 118 is such that the valve is still able to close a vacuum conduit 120 in the region of the die halves 103, 104 within a time period which passes up to the moment when the metal arrives from the sensor 118 to the valve 117. The vacuum conduit 120, instead of comprising a separate control unit which includes a vacuum pump and a vacuum tank (as a vacuum source) and so on, is advantageously coupled to that control unit 114 which also controls the movement of the casting piston 111 so that the parts belonging to the control of the evacuation device are accommodated in the housing where the control unit of the piston 111 are mounted, and no separate control parts have to be provided.

In a typical die casting establishment, the die casting machine 100 is disposed on a floor 130 into which a molten metal receiving well 132 can be formed. Molten metal well receiving well 132 is in fluid communication with a refractory furnace from which molten metal 134 is received. Of course a variety of alternative molten metal retention environments exists, such as, for example, a well in which molten metal is deposited from a remote furnace location via transporting equipment. It would similarly be feasible for molten metal to be delivered to the well via launder system. Nonetheless, the present invention is directed to the utilization of a centrifugal pump 140 to provide molten metal via a conduit 142 extending between the molten metal base 144 to the die casting fill hole 110. It is noted that the run of conduit 142 in FIG. 2 appears lengthy but this depiction is provided only to illustrate the details of the various components. Moreover, it is envisioned that the pump and shot sleeve in practice will be situated significantly closer to one another. Molten metal pump 140 can be the type disclosed in US 2014/0044520, the disclosure which is herein incorporated by reference.

Molten metal pump 140 is in communication with the controller 114. For example, data communication line 150 can be provided between an inverter 152 and the controller 114. Similarly, a data communication line 154 can be provided between an RPM sensing device, such as an encoder 155, and the controller 114.

The controller 114 is used to adjust the RPM of the pump motor 153. By controlling the pump RPM, the shot size and rate of molten metal flow can be controlled. A typical control system will include a programmable logic controller (PLC), a human—machine interface (HMI), and an inverter. An electronic motor encoder 155 may also be present to provide the PLC with a feedback loop coupled with the inverter to monitor pump speed. The motor illustrated in FIG. 2 is a 3-phase variable frequency drive inverter. However, a DC servo motor would be equally suitable.

Figure 3:
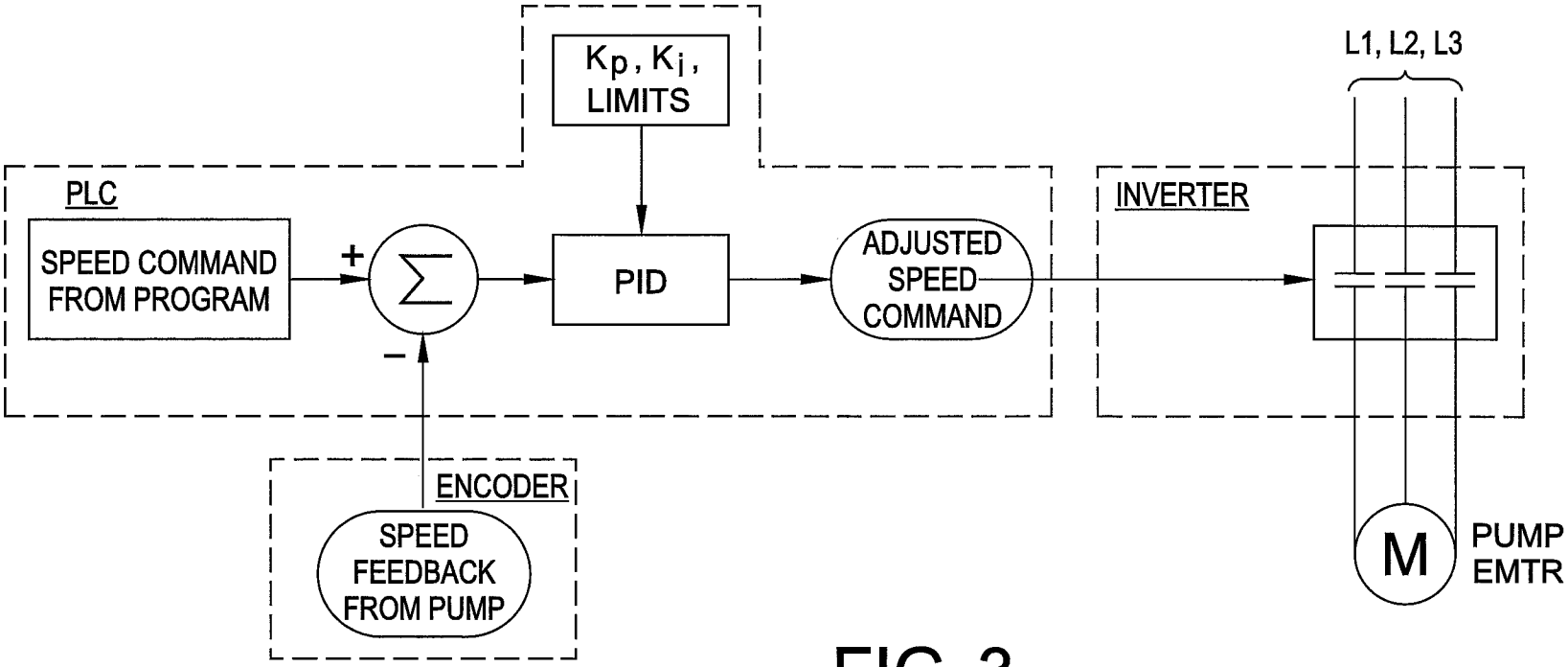
FIG. 3 is a flow chart depicting the feedback loop logic of the present system in association with filling of a molten metal shot sleeve.

With reference to FIG. 3, a precise shot weight can be provided by employing the depicted feedback loop logic control. The PLC logic includes a command speed sent to the pump motor, then utilizing a RPM sensing device, the speed of the pump motor is relayed to the PLC and verified. The PLC program then makes adjustments to the command speed of the pump motor. This cycle is repeated many times per second for accurate RPM control of the pump motor.

Some of the parameters used to calculate the shot volume/quantity can include: 1) cycle time in seconds; 2) RPM of the pump motor; and 3) evaluation of the inverter settings including acceleration, deceleration, speed feedback calculating parameters (other conditions may also be monitored).

The controller can also be in communication with a sensor such as laser sensor 164 (see FIG. 2) to determine the molten metal level within the associated furnace. Moreover, it is believed that molten metal depth may be an important variable effecting shot sleeve fill. Accordingly, the PLC receiving data concerning molten metal depth level will adjust the pump RPM appropriately.

Figure 4:
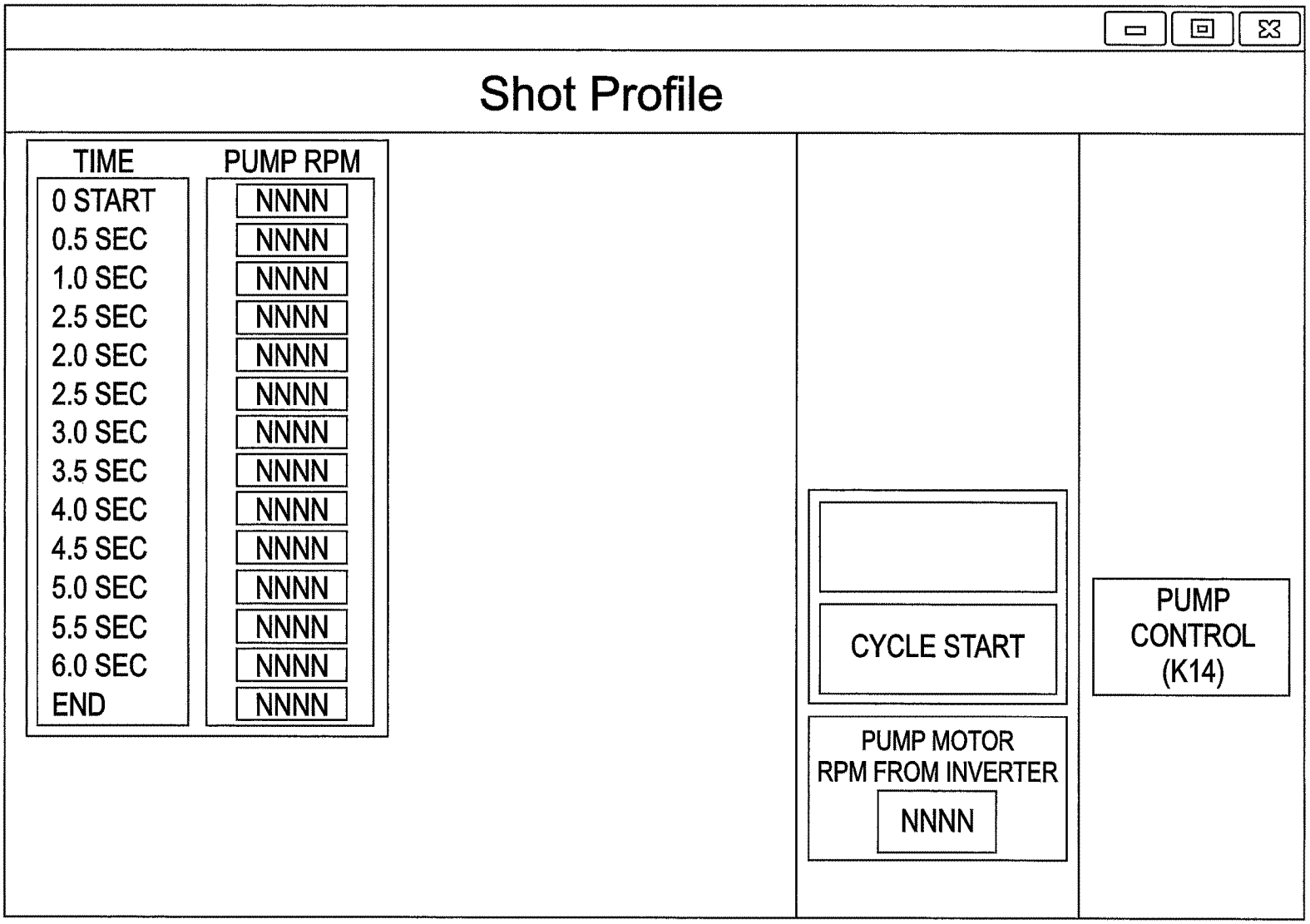
FIG. 4 is a screen shot of a prototypical controller associated with the present pump.

The programming of the shot weight can be automatically calculated from data tables included in the controller programming based on time of fill that an operator inputs via the HMI (See FIG. 4). The operator can manually adjust the shot weight by changing the RPM on one or more entry points and/or the system can use feedback from the die cast machine where, for example, biscuit length is communicated to the controller and fill cycle points automatically adjusted to achieve the correct fill shot weight. (A biscuit is the remaining metal in a shot sleeve after the molten metal is rammed into the die).

Accordingly, the present system may include automatic RPM adjustment features dictated by feedback from the pump inverter and optionally an encoder which are each instructive on the relative performance of the pump. Similarly, automatic RPM adjustment may be made in view of other sensed conditions such as molten metal depth and/or biscuit size. In addition, the system can be manually adjusted by an operator using the HMI of the controller.

With reference to FIG. 4, the HMI screen is depicted. The illustrated screen provides the programmed pump RPM at ½ second intervals throughout a sleeve shot fill cycle. It is envisioned that these entries can be adjusted by an operator. In addition, the HMI interface will include features such as cycle pause, and start keys. Similarly, the ability to monitor pump motor RPM based on inventor data can be provided. It is further envisioned that a pump control pause will be accessible.

Figure 5:
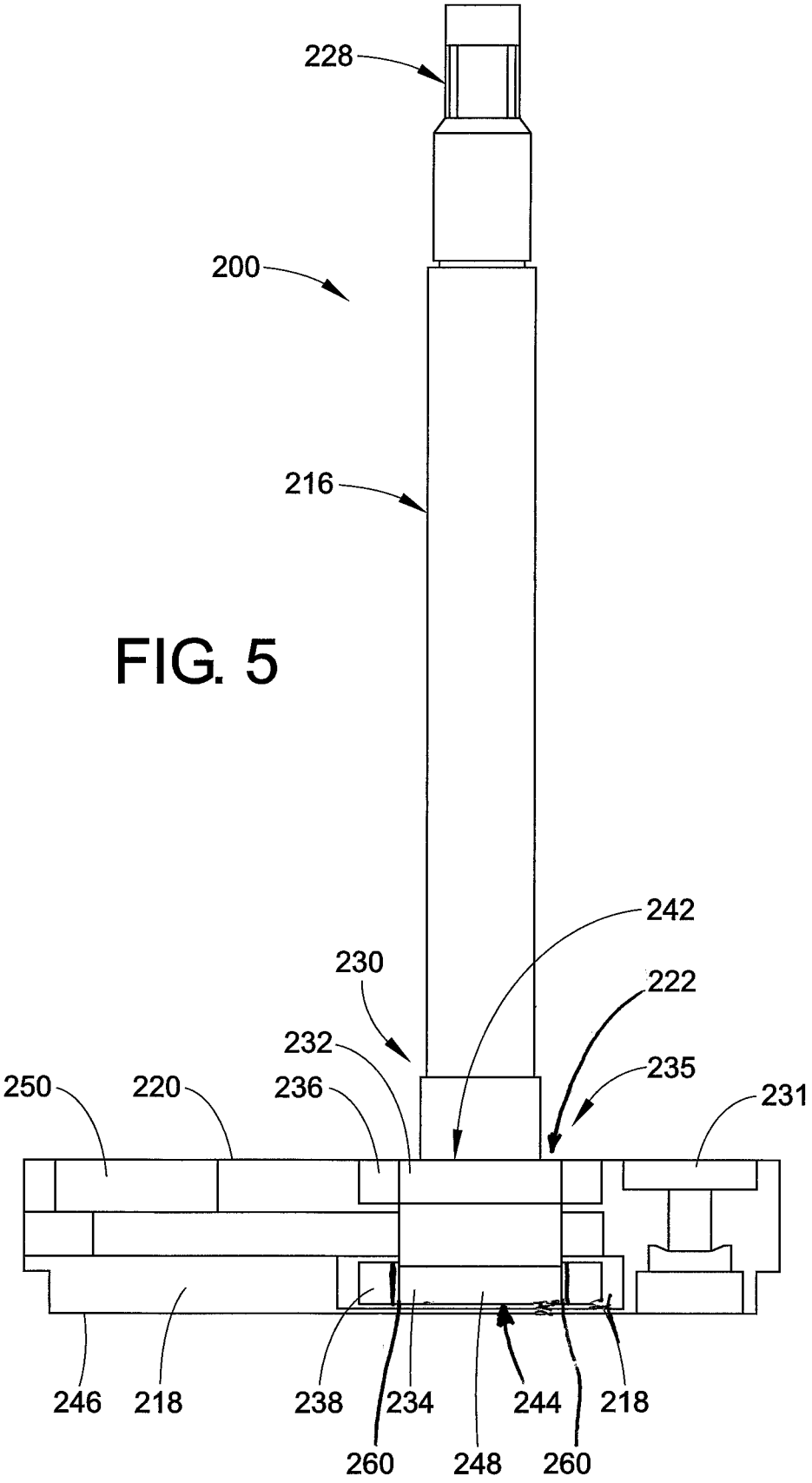
FIG. 5 is a cross sectional view of the centrifugal pump of FIG. 2.

With reference to FIG. 5, elements of the molten metal pump assembly 200 of the present disclosure are illustrated. More particularly, the elongated shaft 216 includes a cylindrically shaped elongated orientation having a rotational axis that is generally perpendicular to the base member 220. The elongated shaft has a proximal end 228 that is adapted to attach to the motor (see FIG. 2) and a distal end 230 that is connected to the impeller 222. Impeller 222 is rotatably positioned within the pump chamber 218 such that operation of the motor rotates the elongated shaft 216 and the impeller 222 within the pump chamber 218.

In certain embodiments, it may be advantageous to provide the motor controlling the rotation of the molten metal shaft with an electronic brake (i.e. 199 in FIG. 2).

The base member 220 defines the pump chamber 218 that rotatably receives the impeller 222. The base member 220 is configured to structurally receive the refractory posts P (see FIG. 2) through passages 231. Each passage 231 is adapted to receive the metal rod component of the refractory post to rigidly attach to a platform PL (see FIG. 2). The platform supports the motor 153 above the molten metal.

In one embodiment, the impeller 222 is configured with a first radial edge 232 that is axially spaced from a second radial edge 234. The first and second radial edges 232, 234 are located peripherally about the circumference of the impeller 222. The radial edges may be formed of the impeller body (e.g. graphite) or may be bearing rings (e.g. silicon carbide) seated to the impeller body. The pump chamber 218 includes a bearing assembly 235 having a first bearing ring 236 spaced from a second bearing ring 238. The first radial edge 232 is facially aligned with the first bearing ring 236 and the second radial edge 234 is facially aligned with the second bearing ring 238. The bearing rings are made of a material, such as silicon carbide, having frictional bearing properties at high temperatures to prevent cyclic failure due to high frictional forces. One of the bearings is adapted to support the rotation of the impeller 222 within the base member such that the pump assembly does not experience excessive vibration. More precisely, one bear ring has a close tolerance with the impeller radial edge to reduce excessive vibration. The second bearing ring is spaced from the radial edge of the impeller and provides a wear surface for the leakage path described below. The radial edges (or bearing ring seated thereon) of the impeller may similarly be comprised of a material such as silicon carbide. For example, the radial edges of the impeller 222 may be comprised of a silicon carbide bearing ring.

In one embodiment, the impeller 222 includes a first peripheral circumference 242 axially spaced from a second peripheral circumference 244. The elongated shaft 216 is attached to the impeller 222 at the first peripheral circumference 242. The second peripheral circumference 244 is spaced opposite from the first peripheral circumference 244 and aligned with a bottom surface 246 of the base member 220. The first radial edge 232 is adjacent to the first peripheral circumference 242 and the second radial edge 234 is adjacent to the second peripheral circumference 244.

A bottom inlet 248 is provided in the second peripheral circumference 244. More particularly, the inlet comprises the annulus of a bird cage style of impeller 222. Of course, the inlet can be formed of vanes, bores, or other assemblies known in the art. As will be apparent from the following discussion, a bored or bird cage impeller may be advantageous because they include a defined radial edge allowing a designed tolerance (or bypass gap) to be created within the pump chamber 218. The rotation of the impeller 222 draws molten metal into the inlet 248 and into the chamber 218 and the continued rotation of the impeller 222 causes molten metal to be forced out of the pump chamber 218 to an outlet 250 of the base member 220. Outlet 250 can be in fluid communication with conduit 142 (see FIG. 2).

A close tolerance is maintained between radial edge 232 of the impeller 222 and the first bearing ring 236 of the bearing assembly 235. For example, the first radial edge 232 surrounds the first bearing ring 236 such that the radial edge 232 rotates while maintaining contact with bearing ring 236 to provide rotational and structural support to the impeller 222 within the chamber 218. It is envisioned that such contact may be in the form of a thin lubricating layer of molten metal.

A bypass gap 260 is provided to manipulate a flow rate and a head pressure of the molten metal. The bypass gap 260 allows molten metal to leak from the pump chamber 218 to an environment outside of the base member 220 at a predetermined rate. Moreover, the predetermined rate can be controlled by the relative size of the bypass gap. The leakage of molten metal from the pump chamber 218 during the operation of the pump assembly allows an associated user to finely tune the flow rate or volumetric amount of molten metal provided to the associated shot sleeve. The leakage rate of molten metal through the bypass gap 260 improves the controllability of the transport of molten metal and is at least in part because a static hold condition can be maintained while the impeller shaft assembly rotates.

The bypass gap 260 can be formed by the second bearing ring 238 wherein the second bearing ring 238 includes a larger internal diameter than the external diameter of the second radial edge 234. Moreover, it is envisioned that one of the two bearing sets has a radial edge engaging and rotatably supported against the bearing ring while the other radial edge is spaced from the associated bearing ring to provide a bypass gap. Optionally, it is contemplated that the bypass gap 260 may be provided between the first radial edge 232 and the first bearing ring 236.

In one embodiment, operation of the pump assembly of the present disclosure includes an ability to statically position molten metal pumped through the outlet at approximately 1.5 feet of head pressure above a body of molten metal. In one embodiment the impeller rotates approximately 850-1000 rotations per minute such that molten metal is statically held at approximately 1.5 feet above the body of molten metal. The bypass gap manipulates the volumetric flow rate and head pressure relationship of the pump such that an increased amount of rotations per minute of the impeller would allow the reduction of head pressure as the flow rate of molten metal is increased.

Figure 6:
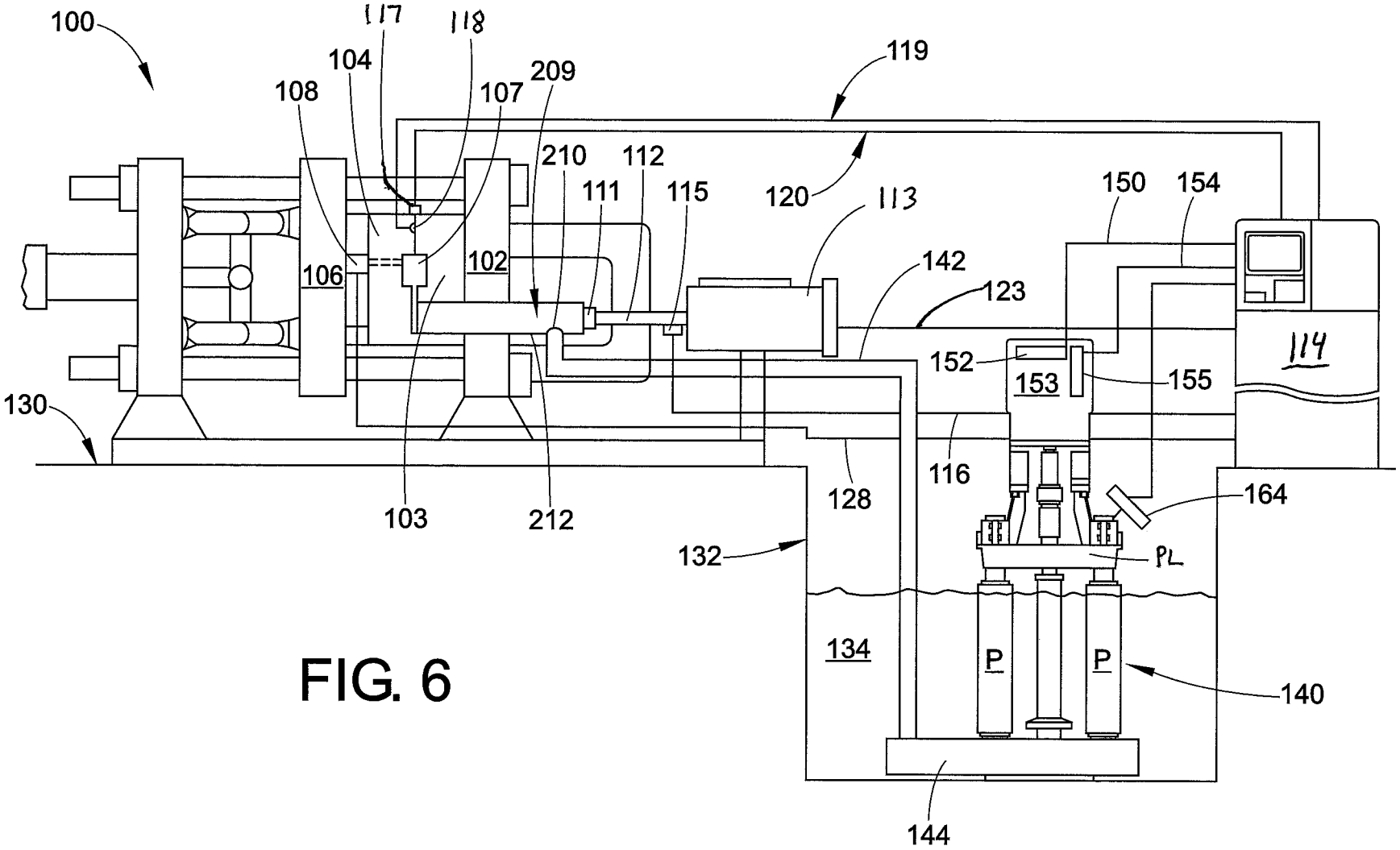
FIG. 6 is a side elevation view of an alternative configuration of a die-casting apparatus.

With reference to FIG. 6, an alternative bottom, feed shot sleeve embodiment is depicted. The depicted apparatus is largely the same as shown in FIG. 2. Accordingly, much of the associated numbering has been retained. However, in this embodiment, a shot sleeve 209 having a filling hole 210 located in a lower surface 212 is provided. This design is considered highly beneficial because it facilitates low turbulence filling of the shot sleeve and associated improved metal quality. Moreover, by providing the molten metal inlet to the shot sleeve in a lower half thereof, a relatively low turbulence fill can be performed. It is noted that the present use of a centrifugal pump to provide molten metal directly to the shot sleeve allows for a lower half inlet, a feature not easily achievable via a ladle fill or pressurized furnace.

It is also noted that the present pump is considered suitable for use with any type of casting apparatus. Moreover, it can be used in vertical and horizontal casting. Furthermore, it can be used with a vertical or horizontally oriented shot sleeve. Similarly, it can be used with a sleeve having a top, bottom or side inlet location and wherein the shot sleeve is in any orientation. Advantageously, this allows die casting operators significantly greater flexibility in the design layout of a casting apparatus and/or multiple casting apparatus.

The present embodiment is advantageous in that the need to expose metal to the atmosphere during ladling can be avoided. Similarly, a filter(s) can be associated with the molten metal pump to deliver high quality metal that is provided from a furnace. In this context, the pump (e.g. adjacent the molding apparatus) may be remote from the furnace and fed by a heated launder system.

It is envisioned that the subject apparatus may benefit by inclusion of a shut-off valve positioned adjacent to the inlet of the permanent mold body. For example, the shut-off valve can be placed between the outlet nozzle from the mold pump and the inlet to the permanent mold body. The shut-off valve may be particularly suitable for use in a mold system including a vertical bottom feed or a horizontal feed into the lower portion of the permanent mold body. More particularly, it is envisioned that the shut-off valve can have value in preventing a back-flow of molten metal. In this regard, while the molten metal pump of the present disclosure is capable of holding molten metal statically, it must remain engaged with the permanent mold during solidification of the casting for the static positioning to prevent leakage. Therefore, the molten metal pump cannot be used immediately to fill a subsequent mold.

In this context, it is contemplated that the shut-off valve can be closed after mold fill, allowing the immediate disengagement of the pump nozzle from the mold body and the re-registration of the pump nozzle with a next mold cavity to be filled. The shut-off valve can be used to prevent the leakage of molten metal from the previously filled cavity during the solidification process. The inclusion of a shut-off valve can increase the process efficiency by allowing the mold pump to more rapidly engage the next mold cavity to be filled.

It is envisioned that after all molds are filled, the permanent mold body can be removed from the casting location and a new permanent mold body brought into association with the casting location. It is noted that the shut-off valve can be disposable such that as each mold body is emptied and prepared for re-use the spent shut-off valve is removed and replaced with a new insert. Alternatively, the shut-off valve assembly may be of a reusable design. Without limitation, exemplary casting equipment with which the present shut-off valve could be utilized include equipment manufactured by Anderson Global, Maumee Pattern, TEI Tooling Equipment International, and Valiant. The present shut-off valve may have value in association with a rotary casting process. An exemplary rotary casting system is described in U.S. Pat. No. 6,637,496, the disclosure of which is herein incorporated by reference.

Figure 7:
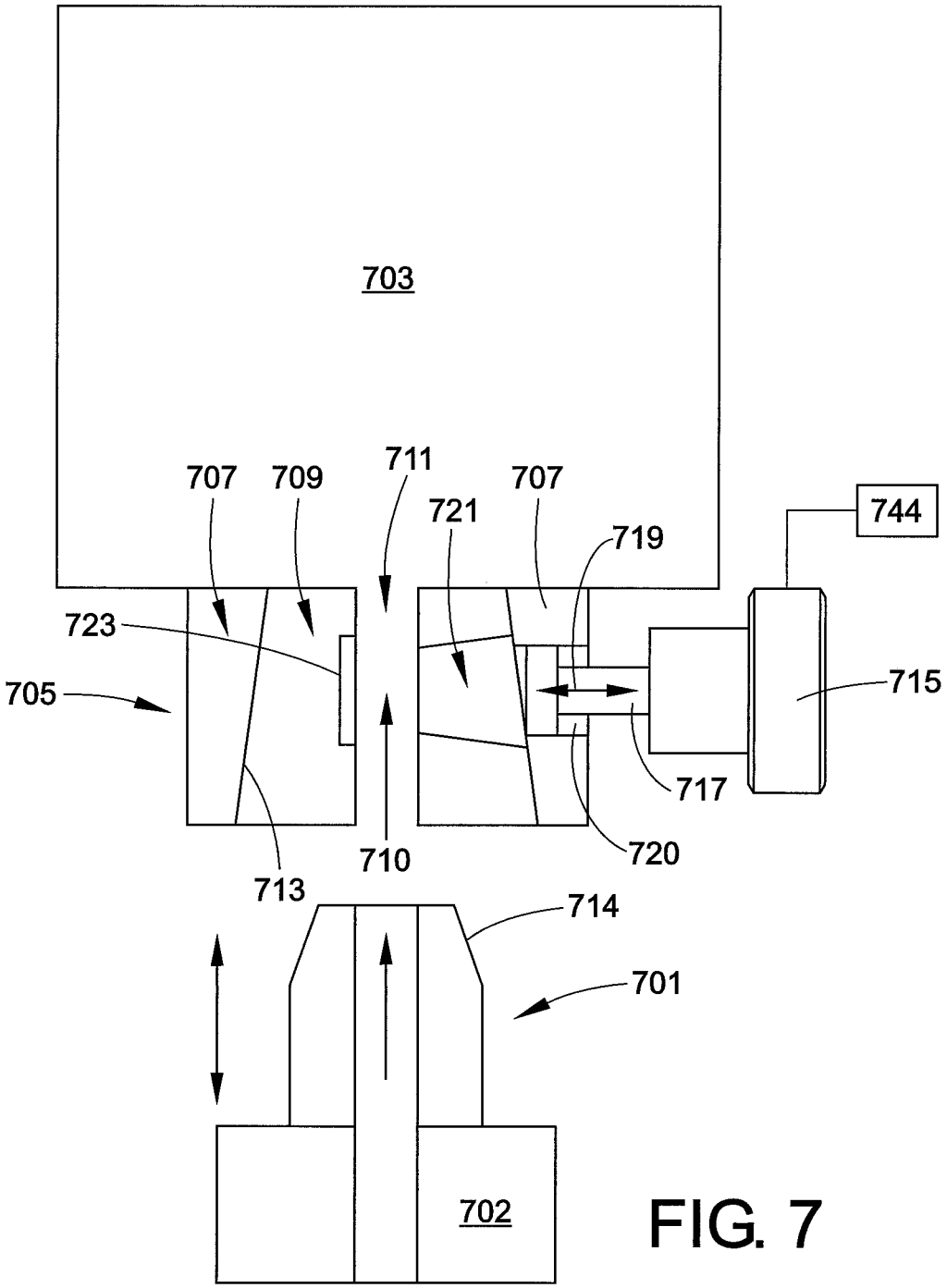
FIG. 7 is a schematic illustration of a shut-off valve assembly.
Figure 8:
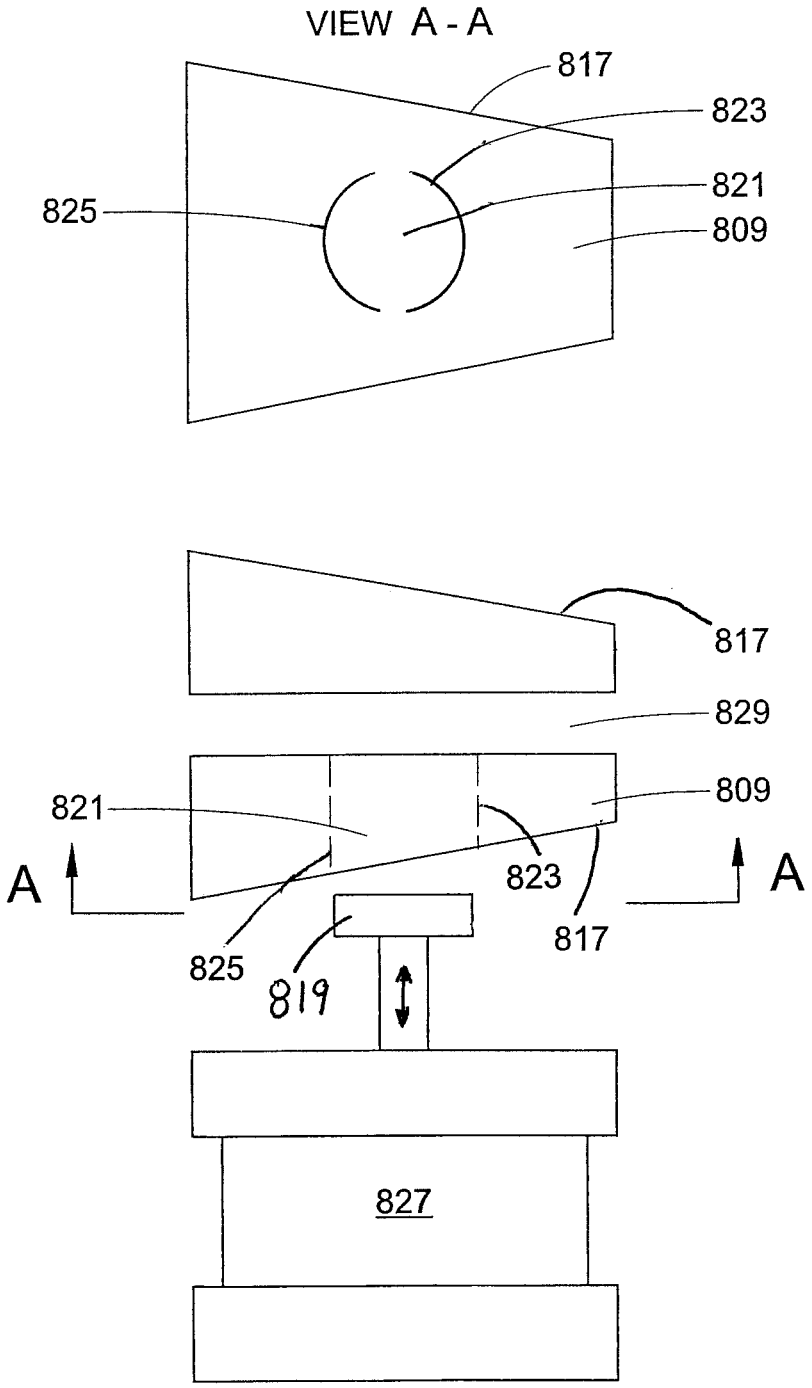
FIG. 8 is a schematic illustration of an alternative shut-off valve assembly.
Figure 9:
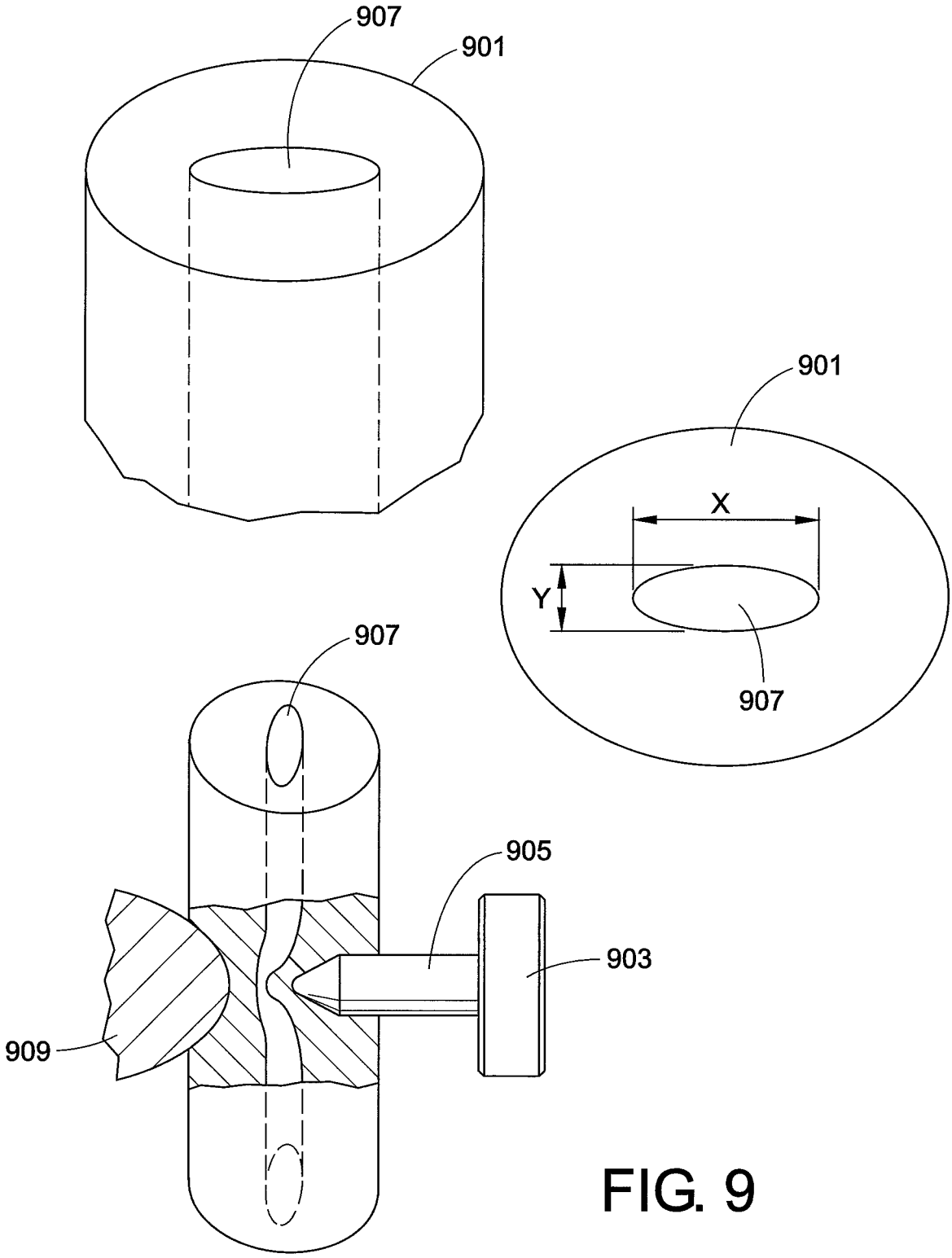
FIG. 9 is a schematic illustration of a further alternative shut-off valve insert.

Turning now to FIGS. 7-9, the shut-off valves depicted therein efficiently (cost, speed, size) allow flow to be shut-off in a permanent mold in which metal such as aluminum has been cast to prevent metal from leaking. It can advantageously be actuated with a high degree of certainty in a short period of time, such as less than two seconds, or less than 1.5 seconds, or less than 1 second. The shut-off valve can be less than approximately 6" long, particularly as used in association with permanent mold carousels.

Turning to FIG. 7, a heated ceramic nozzle 701 is connected to a centrifugal molten metal pump shown schematically as 702 but which can be the type as shown in the preceding figures. However, it is noted that the shut-off valve described herein is not necessarily required to be associated with the mold pump described hereinabove but could be utilized with other mold filling apparatus such as low pressure systems.

The pump 702 and nozzle 701 can be provided with vertical movement, for example, in the range of about 1" to 2". This vertical movement can facilitate the engagement and disengagement of nozzle 701 with a permanent mold 703. Intermediate the nozzle 701 and permanent mold 703 is a shut-off valve assembly 705.

Shut-off valve assembly 705 can include a body portion 707 comprised of, for example, steel. Body portion 707 can be a separate or an integral component of the permanent mold 703. Body portion 707 can, for example, form a generally cylindrical space configured to receive insert 709. Insert 709 can, for example, be a cylindrical disc shaped body. However, the insert is not considered limited to this shape. Insert 709 can be comprised of a resilient material, preferably a compressible material, such as, but not limited to, vacuum formed ceramic fiber or low density ceramic board.

Insert 709 can define a passage 710 intended for alignment with the inlet 711 to the permanent mold 703 for filling a cavity formed therein. Body portion 707 can have a slightly tapered (e.g. between 1° and 5° innermost wall 713 configured for receiving and registering a similarly tapered end portion 714 of nozzle 701.

An air cylinder 715 is in communication with a pump PLC 744 or other probe associated with the mold such that the air cylinder 715 can be actuated and push plunger 717 horizontally along line 719 through passage 720 in body portion 707. Plunger 717 engages a shut-off plug 721 and actuates the valve by pushing plug 721 into the passage 710 sealing the same. Preferably the air cylinder 715 and plunger 717 will have a short stroke length, for example 2". The shut-off plug 721 can be formed with angled (e.g. between 1° and 5° side walls. It is also envisioned that the insert 709 will be comprised of the same or a higher or a lower density material than the plug 721. It is further envisioned that a plug receiving recess 723 may be formed in an opposed wall of the insert 709.

With reference to FIG. 8, an alternative embodiment is depicted wherein the shut-off valve insert body is a one piece construction. Particularly, the plug is formed integrally with the remainder of the insert. Insert 809 can be constructed to have tapered (e.g. 30°) sidewalls 817 for easy registration with the mold inlet. Moreover, an insert 809 can be comprised of the resilient material such as vacuum formed ceramic fiber wherein a plug 821 is partially formed by cutting the material along lines 823 and 825 to create a preferential weakness from which the plug 821 can be separated from the remainder of the insert 809 when acted upon by the plunger 819 and air cylinder 827 (the body portion of the shut-off valve has been omitted in this view). The uncut half round sections can be formed with a cutting blade inserted on each side of the plug about one-half way to the bore. Preferably, sufficient cutting is performed to allow the air cylinder to disengage the plug from the remainder of the body and push it into the molten metal flow. Upon separation, plug 821 enters passage 829 blocking molten metal flow. This results in a stable flow cutoff device for metal solidification.

Turning next to FIG. 9, an alternative configuration is depicted wherein a valve 901 is constructed without a plug but formed of sufficiently resilient and deformable material such that the air cylinder 903 fitted with a wedge shaped ram 905 engages a side wall causing deformation and pinching of the passage 907 to seal the molten metal path. It may be desirable to provide a back-side stop 909 to facilitate pinching passage 907 shut. It is envisioned that the valve can again be formed of resilient fiber reinforced ceramic or a polymeric material. It may be advantageous for the ram 905 to stay engaged during the solidification of the metal in the inlet portion but nonetheless the removal of the engagement of the mold pump nozzle and re-association with a subsequent empty cavity is feasible to increase the efficiency of the mold filling operation. In certain embodiments it may be desirable to form the passage of the insert in an ovoid shape (longer in direction x than in direction y) wherein the ram can engage the insert in a direction transverse to the longer axis such that a decreased amount of deformation is required to shut the passage.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molding machine comprising a cavity to be filled with molten metal comprised of aluminum; a conduit system leading to said cavity and forming a system of interconnected hollow spaces; at least one pressure member comprising a casting piston moveable in at least part of said hollow space system comprising a shot sleeve; wherein a centrifugal pump is in fluid communication with a reservoir of molten metal and the part of said hollow space system receiving the at least one pressure member, said centrifugal pump comprising a base member submerged in the reservoir of molten metal, at least two posts extending between the base member and a motor, a shaft extending between the motor and an impeller disposed in the base member; wherein said molten metal is introduced to said shot sleeve at a bottom side or bottom end; said molding machine further comprising a controller, said controller configured to control the motor associated with the centrifugal pump, said controller receiving data from at least one position, velocity, acceleration, or pressure sensor, said controller using said data to operate the centrifugal pump at a minimum of two different fill speeds during a fill of the shot sleeve; and wherein the conduit system of the molding machine does not include a valve below a surface of the reservoir of molten metal.

2. The molding machine of claim 1 wherein said centrifugal pump includes an electronic brake.

3. The molding machine of claim 1, wherein said controller is further configured to receive data concerning molten metal depth in said reservoir or an associated furnace.

4. The molding machine of claim 1 including a shut-off valve comprised of a resilient material and a plunger configured to deform or actuate said resilient material, said plunger disposed in a wall of the conduit system and wherein said plunger travels perpendicular to a direction of molten metal flow within said shut-off valve.

5. The molding machine of claim 1 wherein said centrifugal pump is comprised of the motor, the shaft, the impeller, and the base member defining a pump chamber having a radial outlet and including at least one bearing ring, said impeller being supported by the shaft and disposed in the pump chamber, the motor providing rotation of the shaft and impeller, wherein the bearing ring supports rotation of the impeller.

6. The molding machine of claim 1, wherein said controller adjusting is further configured to adjust an RPM of the motor of the centrifugal pump.

7. The molding machine of claim 6 wherein biscuit length is communicated to the controller and a fill cycle is automatically adjusted based on said biscuit length.

8. The molding machine of claim 1 wherein a pressurized hold period is included within the different fill speeds.

9. The molding machine of claim 1 including a shut-off valve having a hollow longitudinal axis through which the molten metal flows, said shut-off valve further comprised of a resilient material and a plunger configured to deform or actuate said resilient material, and wherein said plunger travels perpendicular to said longitudinal axis.

10. A molding machine comprising a cavity to be filled with molten metal comprised of aluminum; a delivery system leading to a shot sleeve which communicates with said cavity; at least one pressure member comprising a casting piston moveable in at least part of said shot sleeve; a centrifugal pump in fluid communication with a reservoir of molten metal and the delivery system, said centrifugal pump comprising a base member submerged in the reservoir of molten metal, at least two posts extending between the base member and a motor, a shaft extending between the motor and an impeller disposed in the base member; said molding machine further comprising a controller, said controller configured to control the motor associated with the centrifugal pump, said controller receiving data from at least one position, velocity, acceleration, or pressure sensor, said controller using said data to operate the centrifugal pump at a minimum of two different fill speeds during a fill of the shot sleeve; wherein the delivery system consists of an uninterrupted conduit extending between the base member and the shot sleeve and wherein the molten metal is introduced to said shot sleeve at a bottom side or bottom end.

11. A molding machine comprising a cavity to be filled with molten metal comprised of aluminum; a delivery system leading to a shot sleeve which communicates with said cavity, the delivery system including only a conduit; at least one pressure member comprising a casting piston moveable in at least part of said shot sleeve; a centrifugal pump in fluid communication with a reservoir of molten metal and the delivery system, said centrifugal pump comprising a base member submerged in the reservoir of molten metal, at least two posts extending between the base member and a motor, a shaft extending between the motor and an impeller disposed in the base member; said molding machine further comprising a controller, said controller configured to control the motor associated with the centrifugal pump, said controller receiving data from at least one position, velocity, acceleration, or pressure sensor, said controller using said data to operate the centrifugal pump at a minimum of two different fill speeds during a fill of the shot sleeve; and wherein the molten metal is introduced to said shot sleeve at a bottom side or bottom end.

* * * * *